United States Patent [19]

McDonald et al.

[11] Patent Number: 4,712,665

[45] Date of Patent: Dec. 15, 1987

[54] CONTAINER LIFT MECHANISM

[75] Inventors: Kenneth P. McDonald, Livonia; Badruddin K. Rangwala, Farmington Hills; Barry C. Owen, Southfield; Frank A. Rodocker, Milford, all of Mich.

[73] Assignee: Ex-Cell-O Corporation, Troy, Mich.

[21] Appl. No.: 894,177

[22] Filed: Aug. 7, 1986

[51] Int. Cl.[4] ..... B65B 3/00

[52] U.S. Cl. ..... 198/346.2; 141/172; 198/468.8

[58] Field of Search ..... 141/148, 172, 253, 263, 141/275; 198/346.2, 468.4, 468.8

[56] References Cited

U.S. PATENT DOCUMENTS

| | | | |
|---|---|---|---|
| 2,579,631 | 12/1951 | Von Hofe et al. | 198/468.4 X |
| 2,614,740 | 10/1952 | Moser | 141/172 |
| 2,680,552 | 6/1954 | Kerr | 141/148 |
| 4,343,391 | 8/1982 | Skrypek et al. | 198/468.4 X |
| 4,351,518 | 9/1982 | Stievenart | 198/468.4 X |
| 4,548,243 | 10/1985 | Diaz | 141/10 X |

FOREIGN PATENT DOCUMENTS

| | | | |
|---|---|---|---|
| 1379204 | 12/1963 | France | 141/275 |

*Primary Examiner*—Henry J. Recla
*Assistant Examiner*—Mark J. Thronson
*Attorney, Agent, or Firm*—John P. Moran

[57] ABSTRACT

A container lifting arrangement wherein a pair of spaced rails and a vacuum cup assembly are concentrically mounted and relatively actuated to raise and lower a container, in part while the container is being conveyed toward a filling station by a conveyor. The vacuum cup is caused to engage the bottom surface of the container only after the container's forward movement has been stopped so as to not be subjected to any sliding action by the container, such action tending to roll the cup's edge and destroy its suction capabilities. Lifting the container before the conveyor stops provides additional time for filling the container.

8 Claims, 6 Drawing Figures

CONTAINER LIFT MECHANISM

TECHNICAL FIELD

This invention relates generally to machines for filling containers with a liquid and, more particularly, to the lifting mechanism therefor.

BACKGROUND ART

For filling containers with liquids, it is well-known to use a so-called "bottom-up" filler technique in order to eliminate the build-up of foam. In this technology, either the filler nozzle is lowered into the container and then raised during the filling sequence, or the container is lifted around the filler nozzle and then lowered during the filling sequence, with the two separating at a rate commensurate with the flow rate of the liquid.

When it is the container which is lifted and then lowered, in lieu of a means for pushing the container downwardly, usually at the top edge thereof, it has been customary to employ a vacuum system wherein a vacuum cup on the end of a vertical actuator engages the bottom surface of the container. This is important to prevent jamming in the event that a filler does not function and an empty, light weight container, such as a paperboard container, does not descend properly. When the container is full, and with higher production rates, the vacuum cup actuator tends to not smoothly deposit the heavy, filled container back onto the conveyor unit, resulting in some splashing of the contents.

The use of the vacuum cup has heretofore required that the line of containers being conveyed toward and away from the filler station have little, if any, forward motion before the vacuum cup actuator begins to lift the container from a conveyor compartment, in order that relative sideward motion between the vacuum cup and the container bottom be minimized so as to eliminate undue wear and rolling of the cup.

DISCLOSURE OF THE INVENTION

A general object of the invention is to provide an improved container lifting arrangement wherein the vacuum cup assistance may be used, but with associated means provided for beginning to raise the container before an indexing conveyor comes to a complete stop, to thereby provide additional filling time without changing the conveyor indexing rate.

Another object of the invention is to provide a container lifting arrangement wherein vertically actuated, dual rail means are employed to engage the bottom of the container and begin lifting the container from its conveyor compartment prior to its reaching the filler station, and then lowering the container back into its conveyor compartment.

A further object of the invention is to provide a container lifting arrangement wherein a rail actuator and a vacuum cup actuator are concentrically mounted and relatively actuated to raise and lower the container, in part while the container is being conveyed toward and away from a filling station, such that the vacuum cup is not subjected to any sliding action by the container, tending to roll its edge and destroy its suction capabilities.

A still further object of the invention is to provide a vertical lifting arrangement for use with a laterally indexing conveyor to lift containers from the conveyor to a "bottom-up" filler, including a pair of concentrically mounted, vertically movable actuators, a pair of spaced lifting rails mounted on the upper end of one of the pair of actuators for lifting a container while the latter is being moved laterally along the rails by the conveyor, a vacuum cup mounted on the upper end of the other of the pair of actuators between the pair of lifting rails so as to normally be positioned below the upper surfaces of the rails, means for moving the pair of actuators either as a unit or relative to one another for at times raising the vacuum cup so as to be level with the upper surface of the rails to engage the container's bottom panels after the rails have lifted the container out of the conveyor.

These and other objects and advantages will become more evident when reference is made to the following drawings and the accompanying description.

BEST MODE OF CARRYING OUT THE INVENTION

Figures 1, 2:
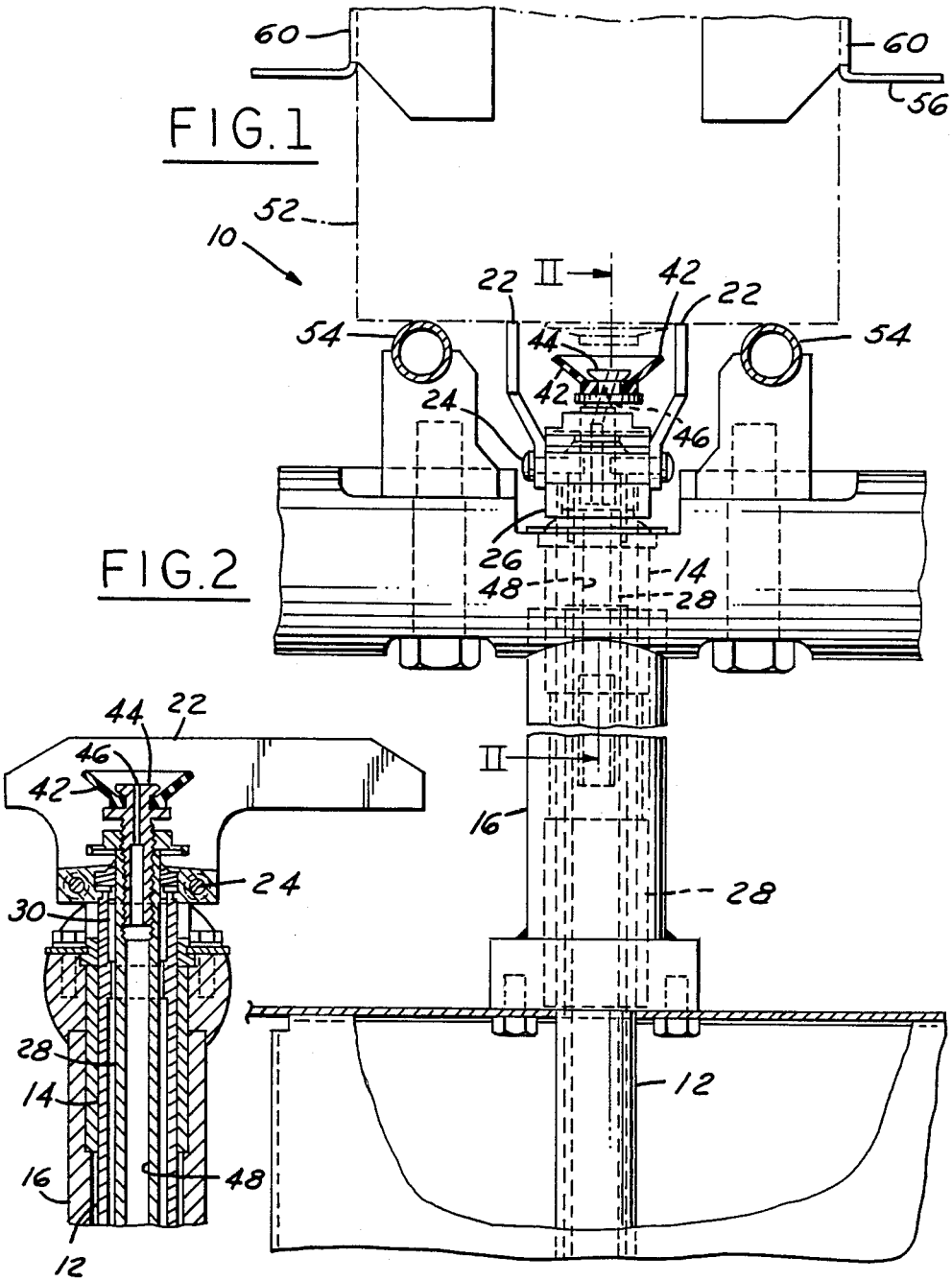
FIGS. 1 and 1A are a plan view in partial cross-section of a container lifting mechanism embodying the invention.
FIGS. 2 and 3 are cross-sectional views taken along the planes of the lines 2—2 and 3—3 of FIG. 1, respectively, and looking in the directions of the arrows.
Figures 1A, 3:
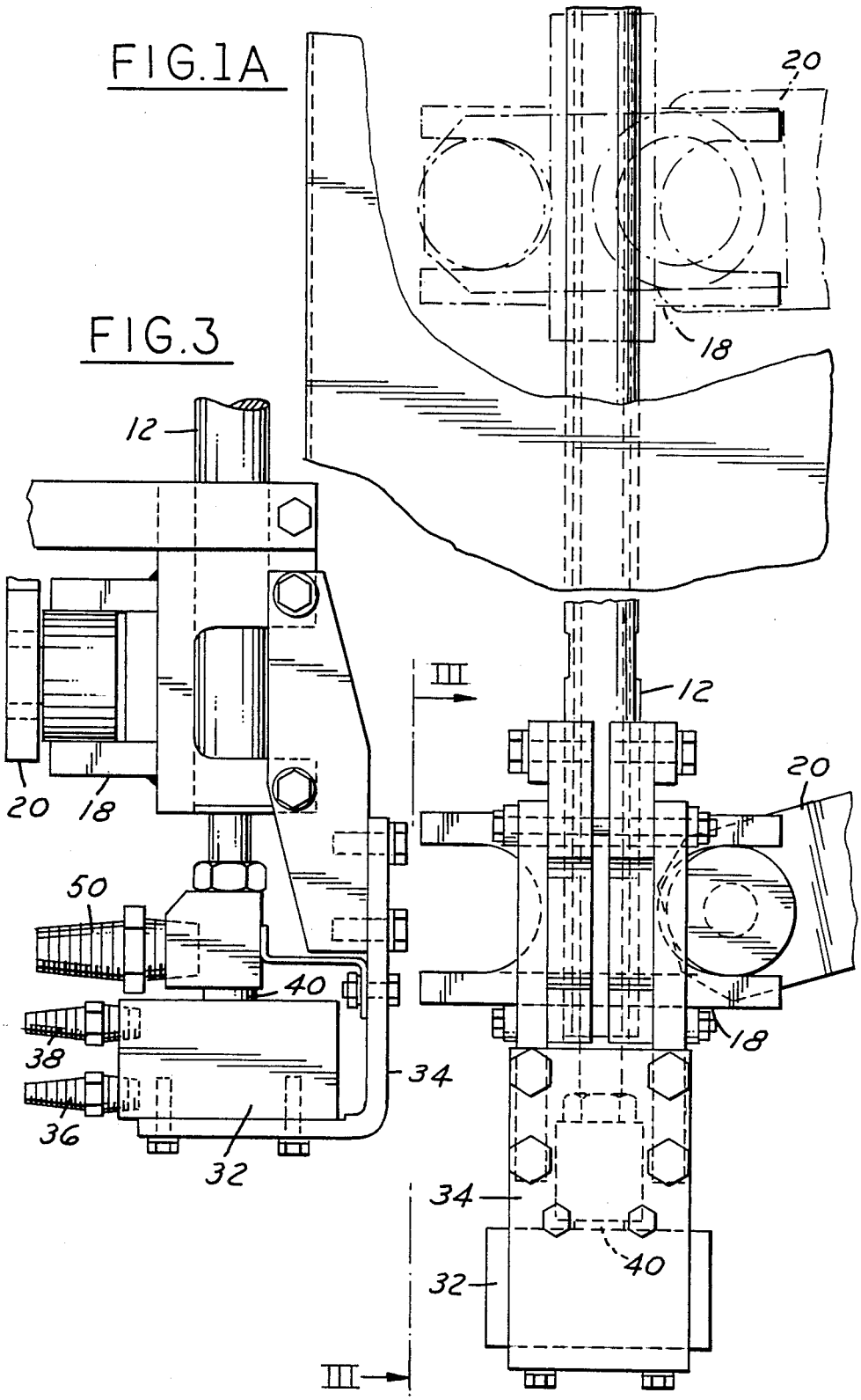

Referring now to the drawings in greater detail, FIGS. 1–4 illustrate a container lifting mechanism 10 including a vertical tube actuator 12 slidably mounted in bearings 14 within a fixed sleeve 16. A connector bracket 18 is secured to the extension of the tube actuator 12 below the sleeve 16, and a linkage member 20 is pivotally connected to the bracket 18, extending from an external power source (not shown). A pair of rails 22 are secured by suitable fasteners 24 to a block 26 which is threadedly secured to the upper end of the vertical actuator 12.

A second vertical tube actuator 28 is slidably mounted in bearings 30 within the vertical tube actuator 12 so as to have independent vertical movement relative thereto. A short stroke air cylinder 32 is mounted on a bracket 34 (FIG. 3) secured to the connector bracket 18, with an inlet 36 and an outlet 38 adapted to being connected with a source of air under pressure (not shown). A cylinder rod 40 extends upwardly from the cylinder 32 and is secured to the second vertical actuator 28. A flexible vacuum cup 42 is mounted around a nozzle 44 threadedly secured to the upper end of the second vertical actuator 28. Vacuum is communicated through a passage 46 formed in the nozzle 44 from the bore 48 of the tubular actuator 28, and an inlet 50 (FIG. 3) adapted to being connected to a source of vacuum (not shown).

Figure 4:
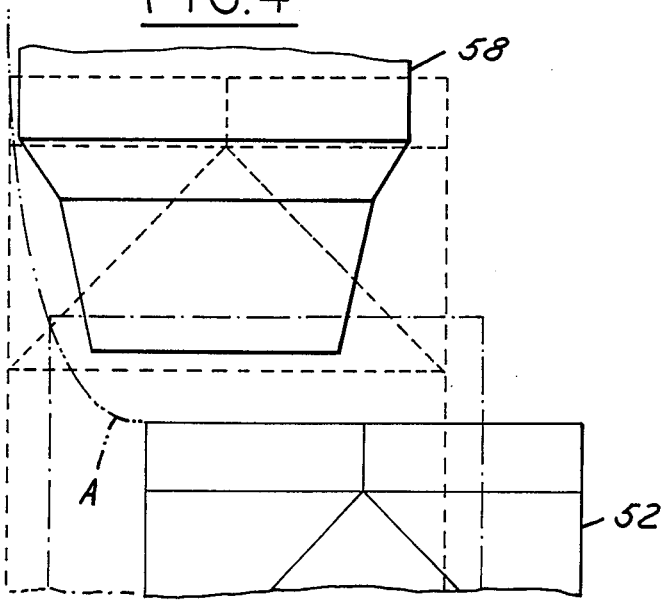
FIG. 4 is a view representing the path of a carton as it is lifted around a filling nozzle in accordance with the teachings of the invention.

Heretofore, a container, which may be a paperboard carton, represented at 52 in FIG. 1 and shown in part in FIG. 4, which is being conveyed along a pair of spaced fixed rails 54 by an indexing conveyor 56, has had to be indexed by the conveyor to a position directly beneath a filling nozzle 58 and substantially stopped before the tubular actuator 12 and its associated linkage member 20 are raised to cause the vacuum cup 42 to engage the bottom of the container and raise it around the filling nozzle. This has been necessary in order to avoid sliding damage to the vacuum cup. The container 52 is confined between front and back pairs of lugs 60 secured to opposite sides of the conveyor 56.

As a result of the cooperation of the air cylinder 32 and its cylinder rod 40 at the lower end of the actuator 28 for the vacuum cup 42, and the tubular actuator 12 and its pair of lifting rails 22, the latter may begin lifting the container 52 from the fixed rails 54 while the container is still being conveyed by the lugs 60 of the conveyor 56. Tests have shown that the best time for actuating the vacuum cup 42 is approximately at the point where the container is lifted approximately half its height. It is at this point that lateral or forward motion of the container has substantially stopped and the rails 22 are still in accelerating engagement with the bottom of the container.

By virtue of the preliminary lifting of the container by the rails 22 along a path represented by A in FIG. 4, the container is in place around the filling nozzle 58 sooner than if the rails 22 were not used. Hence, the filling cycle may be increased, thereby reducing the tendency of the liquid contents to foam. After being positioned around the nozzle, while being filled, the container is lowered at a predetermined rate by the tube 12 and the rails 22, assisted by the vacuum cup 42, until it once again is deposited between the pairs of lugs 60 of the conveyor 56. The cup 42 is preferably withdrawn from the bottom of the container after the top of the carton clears the bottom of the filler nozzle amd prior to the conveyor 56 beginning to move. At this point, the vertically movable rails 22 are a predetermined distance above the fixed rails 54, say ½ of an inch. The conveyor then begins to move while the rails 22 proceed down to approximately 1/16 of an inch above the fixed rails 54, such that there is no severe drop when the container leaves the downstream end of the rails 22.

Figure 5:
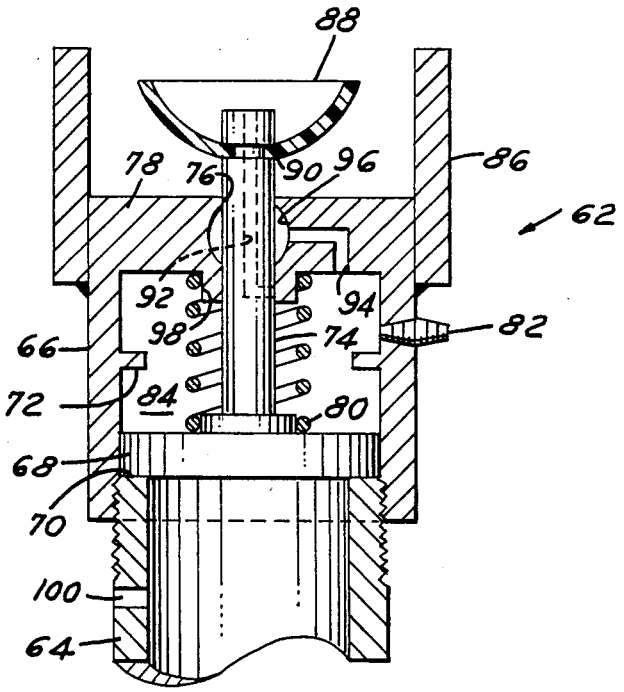
FIG. 5 is a schematic view in cross-section of an alternate embodiment of the invention.

Referring now to FIG. 5, there is illustrated an alternate embodiment of a container lifting mechanism 62, wherein there is only one tubular actuator 64 threadedly connected to a stainless steel housing 66 in which a piston 68 is slidably mounted between lower and upper abutments 70 and 72, respectively. A stem 74 extends upwardly from the piston 68 through an opening 76 formed in the cover portion 78 of the housing 66. A spring 80 is mounted between the cover portion 78 and the piston 68. An inlet 82 is formed in a wall of the housing 66, communicating between the housing chamber 84 and a source of vacuum (not shown).

Rails 86 similar to the rails 22 of FIG. 1 are secured to the outside of the housing 66, extending upwardly therefrom. A vacuum cup 88 is mounted on the upper end of the stem 74, secured in an annular notch 90 formed therein. A first right angled passageway 92 is formed in the stem 74, and a second right angled passageway 94 is formed in the cover portion 78. An annular groove 96 is formed in the wall surface 98 of the opening 76, communicating with the passageway 94. The tubular actuator 64 is vented to atmosphere by a vent opening 100.

In operation, when it is desired to actuate the suction cup upwardly between the rails 86, vacuum is applied through the inlet 82 to the chamber 84, whereupon atmospheric pressure against the underside of the piston 68 lifts the piston against the force of the spring 80 to the abutment 72, serving to bring the passageway 92 into alignment with the annular groove 96 and its associated passageway 94, to thereby provide suction for the vacuum cup 88 to engage and hold the container bottom.

Once the vacuum into the chamber 84 is replaced by atmospheric pressure, the spring 80 serves to urge the piston downwardly to its normal position against the abutment 70, releasing the vacuum cup 88 from the bottom of the container. In lieu of the spring 80, a pressure greater than atmospheric may be introduced into the chamber 84 to urge the piston downwardly.

INDUSTRIAL APPLICABILITY

By virtue of the initial lifting and final lowering of the container while the container is still being moved laterally by the indexing conveyor, prior to engagement of the container bottom by the vacuum cup, it is apparent that there is no drag on the cup to cause its edge to be rolled into itself, a condition which destroys the cup's ability to gain a suction hold on the container bottom. It follows that, so long as the vacuum cup and its actuator are not the sole lifting means for the container, the lifting by the pair of rails may begin before the container stops, thereby improving the efficiency of the overall operation by providing additional time for filling, without having to change the speed of the indexing conveyor. Also, it should be apparent that the filled container may be more smoothly deposited back in the conveyor, eliminating splashing of the contents which may interfere with the subsequent top sealing operation.

While but two embodiments have been shown and described, other modifications thereof are possible within the scope of the following claims.

The embodiments of the invention in which an exclusive property or privilege is claimed are defined as follows:

1. A container lift mechanism comprising a set of spaced lifting rails mounted at the top of a vertically oriented tubular actuator, first lifting means operatively connected to said actuator for vertically lifting same, a vacuum cup independently mounted between said spaced rails, and second lifting means operatively connected to said tubular actuator for vertically lifting said vacuum cup relative to the movement of said tubular actuator for at times engaging the bottom of a container riding on said rails.

2. The container lift mechanism described in claim 1, wherein said second lifting means includes a second tubular actuator concentrically mounted within said first mentioned tubular actuator, and a cylinder secured for movement with the latter actuator and having a cylinder rod connected to said second tubular actuator.

3. The container lift mechanism described in claim 1, wherein said second lifting means includes a housing secured to said tubular actuator, a spring-loaded piston slidably mounted in said housing and having a stem extending through the top of said housing with said vacuum cup being secured to the extended stem, an inlet in said housing for communicating vacuum into said housing for at times raising said piston, a first passageway formed in said top of said housing in communication with the interior of said housing, and a second passageway formed in said stem for communicating between said vacuum cup and said first passageway when said piston is in its raised position.

4. The container lift mechanism described in claim 3, wherein said set of spaced lifting rails is mounted on said housing so as to extend upwardly therefrom.

5. A container lift mechanism comprising a set of spaced lifting rails mounted at the top of a vertically oriented tubular actuator, means operatively connected to said actuator for vertically lifting same, a vacuum cup mounted at the top of a second vertically oriented actuator independently mounted within said tubular actuator, and a cylinder secured for movement with said tubular actuator and having a cylinder rod extending therefrom and connected to said second actuator for vertically moving said vacuum cup relative to the movement of said tubular actuator for at times engaging the bottom of a container riding on said rails.

6. A container lift mechanism comprising a vertically oriented tubular actuator, means operatively connected to said actuator for vertically lifting same, a housing mounted at the top of said vertically oriented actuator, a set of spaced lifting rails mounted at the top of said housing, a piston slidably mounted in said housing, a stem extending upwardly from said piston through the end wall of said housing, a vacuum cup mounted on the end of said stem, means in said housing for urging said piston downwardly so as to locate said vacuum cup below the plane of the top surfaces of said spaced lifting rails, an inlet in said housing for communicating vacuum into said housing for at times raising said piston and its associated vacuum cup relative to the movement of said tubular actuator for at times engaging the bottom of a container riding on said rails.

7. The container lift mechanism described in claim 6, and a first passageway formed in said end wall of said housing, and a second passageway formed in said stem for communicating between said first passageway and said vacuum cup when said piston is in its raised position as a result of the application of vacuum to the stem side of said piston.

8. For use with a conveyor, a container lift mechanism comprising a pair of concentrically mounted, vertically movable actuators, a pair of spaced lifting rails mounted on the upper end of one of said pair of actuators for lifting a container while the latter is being moved laterally along said rails by said conveyor, a vacuum cup mounted on the upper end of the other of said pair of actuators between said pair of spaced lifting rails so as to normally be positioned below the upper surfaces of said pair of rails, means for moving said pair of actuators alternately as a unit and relative to one another so as to at times raise said vacuum cup to the level of said upper surface of said pair of rails in order to engage said container bottom after said pair of rails has lifted said container out of said conveyor.

* * * * *